US012163756B1

(12) United States Patent
Robison et al.

(10) Patent No.: US 12,163,756 B1
(45) Date of Patent: Dec. 10, 2024

(54) LOADING APPARATUS AND METHOD THEREOF

(71) Applicants: David Robison, Framingham, MA (US); Timothy Quinn, Gloucester, MA (US)

(72) Inventors: David Robison, Framingham, MA (US); Timothy Quinn, Gloucester, MA (US)

( * ) Notice: Subject to any disclaimer, the term of this patent is extended or adjusted under 35 U.S.C. 154(b) by 0 days.

(21) Appl. No.: 18/203,450

(22) Filed: May 30, 2023

(51) Int. Cl.
*F41A 9/85* (2006.01)

(52) U.S. Cl.
CPC ..... *F41A 9/85* (2013.01)

(58) Field of Classification Search
CPC ..... F41A 9/82; F41A 9/83; F41A 9/85
USPC ..... 42/89
See application file for complete search history.

(56) References Cited

U.S. PATENT DOCUMENTS 201,855 A * 3/1878 White ..... F41A 9/83 224/931
202,613 A * 4/1878 White ..... F41A 9/72 42/87
1,228,505 A * 6/1917 Wesson ..... F41A 9/85 42/89
1,245,499 A * 11/1917 Orme ..... F41A 17/38 124/52
3,343,295 A * 9/1967 Grosbard ..... F41A 9/85 42/89
4,229,896 A * 10/1980 Jurich, III ..... F41A 9/85 42/89
4,888,902 A * 12/1989 Knowles ..... F41A 9/83 42/87
5,402,594 A * 4/1995 Switzer ..... F41A 9/83 42/87
5,548,916 A * 8/1996 Kinsel ..... F41A 9/85 42/89
9,068,787 B1 * 6/2015 Jensen ..... F41A 9/83
11,493,294 B2 * 11/2022 Bryant, II ..... F41A 9/85
2015/0316341 A1 * 11/2015 Aguilar ..... F41A 9/83 42/87

* cited by examiner

*Primary Examiner* — Bret Hayes
(74) *Attorney, Agent, or Firm* — Patterson Intellectual Property Law, P.C.; Ryan D. Levy

(57) ABSTRACT

A loading apparatus of the present disclosure may be configured to receive one or more cartridges and assist with loading the one or more cartridges when received by the loading apparatus into a revolver. The loading apparatus may comprise a housing, a follower, a spring, and a release mechanism. The housing may include at least an upper end and a forward upper opening configured to receive therein and dispense therefrom the one or more cartridges. The spring is configured to apply an upward force to the follower towards the upper portion of the housing. The release mechanism may be defined on the housing and be configured to selectively disengage the upward force of the spring from an uppermost cartridge of the one or more cartridges while maintaining the upward force on the follower and any other cartridges of the one or more cartridges when received by the housing.

19 Claims, 16 Drawing Sheets

LOADING APPARATUS AND METHOD THEREOF

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present invention relates generally to firearm reloaders. More particularly, the present disclosure pertains to a loading apparatus for use with a revolver.

2. Description of the Prior Art

Hand-held firearms have widely been used by the law enforcement, the military and civilians for a long time. A preferred firearm for many people is the revolver. The revolver is universally accepted because of its simple mechanical design which makes for consistent reliability in the field. Properly maintained revolvers are incredibly dependable hence their popularity for those with personal protection goals. Notwithstanding the many advantages of revolvers, the main disadvantage is that revolvers contain a limited number of shots in one load. As a result, revolvers require frequent reloading, and the precious time spent on reloading significantly reduces the time the firearm can actually be used for firing at targets such as, for example, personal protection in a crisis situation. Revolvers are particularly prone to this type of deficiency since the cartridges generally have to be hand loaded into the revolver cylinder one cartridge at a time.

There are revolver reloading devices that increase the speed at which a user can reload the revolver. In general, there are three types of revolver reloading devices currently available and widely accepted: strip loaders, cylindrical loaders, and moonclips. Each type of revolver reloader, however, has significant drawbacks.

Strip loaders are a popular type of revolver reloading device consisting of a flexible polymer strip with a plurality of cylindrical receptacles spanning at least a portion of the strip. Each of the plurality of cylindrical receptacles is configured to receive and retain a bottom portion of the casing of a cartridge (e.g., at least the portion including the rim). At least one cartridge of the strip loader may be pressed into one or more of the plurality of chambers of the revolver cylinder before the corresponding portion of the strip loader is peeled away from the inserted cartridge(s). A consistent drawback of these strip type loading devices, however, is that during storage cartridge(s) may accidentally separate from the cylindrical receptacles, for example, in one's pocket when not stored in some type of sleeve, and further leave lead residue in one's pocket or storage bag. They are also hard to remove from one's pocket because a user's entire hand must enter the pocket to retrieve the strip type loading device from the bottom portion of the pocket.

Cylindrical revolver loaders are very well known to the art and have been around for many years in one form or another. A cylindrical revolver reloader functions to retain and store five or six cartridges in a fixed cylindrical position. One of the advantages of a cylindrical reloader is the simultaneous loading of all cartridges into the respective chambers of the revolver cylinder saving precious time in a crisis situation. However, the consistent drawback to every revolver reloader is that they have poor and bulky storage. Thus, the draw/access is slow and cumbersome. Further, cylindrical revolver reloaders are not suited for a tactical reload (e.g., a partial reload of fired cartridges only, while leaving unfired cartridges). Since cylindrical revolver reloaders comprise a cylinder matching the diameter of the revolver, they are not easily concealable, difficult to draw/retrieve, and further leave lead in one's pocket when stored in one's pocket or storage bag.

Moonclips are also well known as revolver reloading devices. Moonclips are thin metal clips that hold a full, half, or one-third reload. Moonclips require the cylinder of the revolver to have a machined recess to accommodate the moonclip, thereby permanently altering the revolver and requiring the use of moonclips in order to safely operate the revolver. This is why moonclips are mostly used in competition revolver shooting. Moonclips may be prone to becoming bent during storage in a pocket, pouch, or bag when carried for personal protection. Once bent, the moonclip will not seat into the cylinder properly. This could prevent the cylinder from properly latching and cause a malfunction. Another drawback is that during storage, cartridges may detach from the moonclip and/or leave lead in one's pocket or storage bag.

BRIEF SUMMARY

In view of at least some of the above-referenced problems in conventional revolver reloading devices, an exemplary object of the present disclosure may be to provide a new and improved loading apparatus and method of loading the chambers of a revolver cylinder.

An exemplary such apparatus may desirably feature an ergonomic ambidextrous release mechanism configured to allow the user to easily dispense one cartridge upon engagement thereof. The exemplary such apparatus may further feature automatic reset when the release mechanism is disengaged. The exemplary such apparatus may feature an advanced forward position for the uppermost cartridge sought to be dispensed such that at least a portion of the tip of the uppermost cartridge may be inserted into the chamber of the revolver prior to engagement of the release mechanism, thereby increasing loading precision and speed.

In a particular embodiment, an exemplary loading apparatus for a revolver as disclosed herein may include a housing, a follower, a spring, and a release mechanism. The housing may include a forward wall, a rearward wall, first and second sidewalls extending between the forward wall and the rearward wall, an upper portion, and a forward opening defined between the forward wall and the upper portion. The follower may be positioned within the housing and include an angled upper surface. The spring may be positioned within the housing and configured to apply an upward force to the follower towards the upper portion of the housing. The release mechanism may be defined on the housing and may further be configured to selectively disengage the upward force of the spring from an uppermost cartridge of one or more cartridges when received by the housing while maintaining the upward force on the follower and any other cartridges of the one or more cartridges when received by the housing between the follower and the release mechanism.

In an exemplary aspect according to the above-referenced embodiment, an inner surface of the upper portion may include a ramp surface portion and a forward surface portion. The ramp surface portion may be more steeply angled relative to the rearward wall than the forward surface portion.

In another exemplary aspect according to the above-referenced embodiment, the ramp surface portion may include a smooth surface covering configured to reduce resistance on a cartridge of the one or more cartridges as it slides up and forward along the smooth surface covering of the ramp surface portion.

In another exemplary aspect according to the above-referenced embodiment, a ramp angle of the ramp surface portion may be between about 125 degrees and about 135 degrees relative to rearward wall of the housing.

In another exemplary aspect according to the above-referenced embodiment, a forward angle of the forward surface portion may be between about 95 degrees and about 105 degrees relative to the rearward wall of the housing.

In another exemplary aspect according to the above-referenced embodiment, the inner surface of the upper portion further includes an indentation defined between the ramp surface portion and the forward surface portion. The indentation may be configured to receive a portion of a rim of the uppermost cartridge of the one or more cartridges when received by the housing to define an advanced forward position of the uppermost cartridge.

In another exemplary aspect according to the above-referenced embodiment, at least 20 percent of a length of the uppermost cartridge of the one or more cartridges when received by the housing may extend beyond a top edge of the forward opening of the housing when in the advanced forward position.

In another exemplary aspect according to the above-referenced embodiment, the uppermost cartridge of the one or more cartridges when received by the housing may extend beyond a top edge of the forward opening of the housing by at least one-quarter of an inch when in the advanced forward position.

In another exemplary aspect according to the above-referenced embodiment, the upper portion of the housing may be closed and may include at least a first angled exterior surface extending from the rearward wall and a second angled exterior surface angled downwardly from the first angled exterior surface towards the forward opening. The first and second angled exterior surfaces may define a strike cap for personal protection purposes.

In another exemplary aspect according to the above-referenced embodiment, the release mechanism may include a first cantilevered button integrally formed in the first sidewall of the housing and a second cantilevered button integrally formed in the second sidewall of the housing. The upward force of the spring may be disengaged from the uppermost cartridge of the one or more cartridges received by the housing upon engagement of at least one of the first or second cantilevered buttons.

In another exemplary aspect according to the above-referenced embodiment, each of the first and second cantilevered buttons may include a boss extending from an interior surface of the first or second cantilevered button, respectively.

In another exemplary aspect according to the above-referenced embodiment, the boss of each of the first and second cantilevered buttons may be sloped away from the interior surface towards an upper free end portion of the first or second cantilevered button, respectively.

In another exemplary aspect according to the above-referenced embodiment, the angled upper surface of the follower may be angled between about 70 degrees and about 82 degrees from the rearward wall such that the angled upper surface is angled upward towards the forward wall.

In another exemplary aspect according to the above-referenced embodiment, an opening height of the forward opening may be in a range of from 0.4 inches to 0.9 inches.

In another exemplary aspect according to the above-referenced embodiment, the housing may include a forward ramp defined between an inner surface of the forward wall and a lower edge of the forward opening. The forward ramp may be configured to guide a second cartridge of the one or more cartridges positioned immediately below the uppermost cartridge when received by the housing back towards the rearward wall when the release mechanism is engaged.

In another exemplary aspect according to the above-referenced embodiment, a ramp joint may be defined between the forward ramp and the inner surface of the forward wall. The ramp joint may be configured to prevent forward movement of the second cartridge after engaged by the release mechanism.

In another exemplary aspect according to the above-referenced embodiment, the follower includes a forward surface having a forward height and a rearward surface having a rearward height. The ratio between the forward height and the rearward height is in a range of from 1.1:1 to 1.6:1.

In another embodiment, an exemplary method of loading one or more cartridges into one or more chambers of a cylinder of a revolver as disclosed herein may include (a) providing a loading apparatus containing the one or more cartridges with an uppermost cartridge of the one or more cartridges protruding at least partially from a front upper opening of the loading apparatus to define an advanced forward position of the uppermost cartridge; (b) at least partially inserting a tip of the uppermost cartridge into one of the one or more chambers with the tip pointing in a downward vertical direction; (c) engaging a release mechanism of the loading apparatus to free the uppermost cartridge from the loading apparatus; and (d) gravity feeding the uppermost cartridge into the one of the one or more chambers in which the tip of the uppermost cartridge was partially inserted.

In an exemplary aspect according to the above-referenced embodiment, the method may further comprise disengaging the release mechanism to allow a following cartridge of the one or more cartridges to move upward into the advanced forward position such that it is received by an indentation. In accordance with this aspect, the method may further include repeating steps (b) through (d) for each following cartridge when in the advanced forward position for different ones of the one or more chambers of the cylinder of the revolver.

In another embodiment, an exemplary method of loading one or more cartridges into a loading apparatus having a front opening as disclosed herein may include (a) engaging a release mechanism of the loading apparatus to move a follower of the loading apparatus away from an upper portion of the loading apparatus; (b) inserting a first cartridge of the one or more cartridges into a front opening of the loading apparatus, the front opening located proximate to the upper portion; (c) disengaging the release mechanism to allow the follower to engage the first cartridge; (d) pushing the first cartridge straight back into the front opening such that the first cartridge engages a ramp surface of the upper portion and moves away from the upper portion; and (e) engaging the release mechanism of the loading apparatus to move the first cartridge and the follower away from the upper portion of the loading apparatus while maintaining an upward force on the first cartridge between the follower and the release mechanism.

In an exemplary aspect according to the above-referenced embodiment, the method may further comprise repeating steps (b) through (e) for each additional cartridge of the one or more cartridges.

BRIEF DESCRIPTION OF THE SEVERAL VIEWS OF THE DRAWINGS

FIG. 15B illustrates the method shown in the flow diagram of FIG. 14 regarding a step of freeing a cartridge from the loading apparatus.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof. Furthermore, any part of the apparatus of the present disclosure may be made using any applicable manufacturing method, such as, but not limited to 3D printing, injection molding, or the like.

Figure 1:
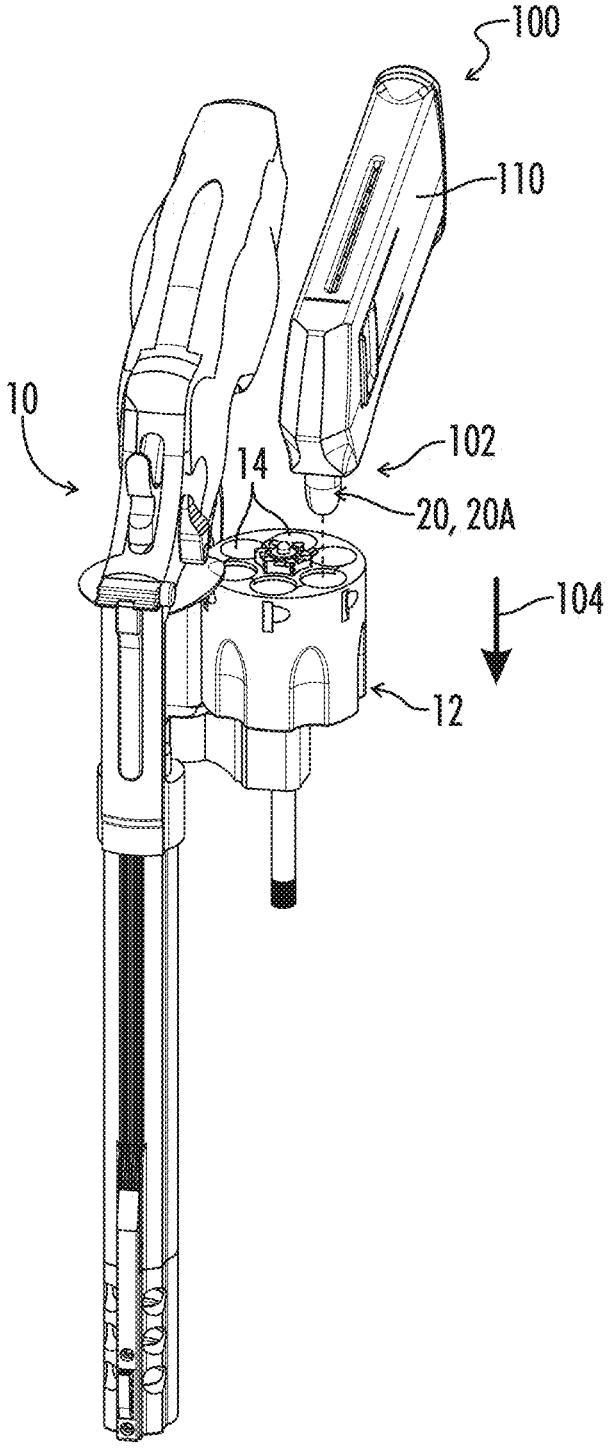
FIG. 1 is a perspective view of an embodiment of a loading apparatus in combination with a revolver in accordance with the present disclosure.

Referring to FIGS. 1-10, an embodiment of a loading apparatus 100 in accordance with the present disclosure is shown. The loading apparatus 100 may also be referred to herein as a loading device 100, a reloading apparatus 100, or a reloading device 100. As illustrated in FIG. 1, the loading apparatus 100 is configured to assist in loading or reloading one or more cartridges 20 into a revolver 10. The revolver 10 generally has a cylinder 12 hingedly coupled to the revolver. The cylinder 12 may include one or more chambers 14 with each chamber 14 configured to receive one of the one or more cartridges 20. Each of the one or more cartridges may include a casing 22 with a rim 24, and a tip portion 26 extending from the casing 22 and positioned opposite the rim 24. The casing 22 may also be referred to herein as a case 22. The tip portion 26 may also be referred to herein as a tip 26.

The loading apparatus 100 may comprise a housing 110 configured to receive and store the one or more cartridges 20 prior to being loaded into the revolver 10. The housing 110 may include a forward wall 112, a rearward wall 114, first and second sidewalls 116, 118 extending between the forward wall 112 and the rearward wall 114. The forward and rearward walls 112, 114 may be parallel to one another and perpendicular to the first and second sidewalls 116, 118. The first and second sidewalls 116, 118 may be parallel to each other. The housing 110 may further include an upper portion 120 coupled to at least the rearward wall 114 and the first and second sidewalls 116, 118. The upper portion 120 may also be referred to herein as a closed upper portion 120 as the upper portion 120 may be closed, partially closed, partially open, or the like in various embodiments of the loading apparatus 100. The housing 110 may still further include a forward opening 130 defined between the forward wall 112 and the upper portion 120. The forward opening 130 may also be referred to herein as a front opening 130, a front upper opening 130, an upper front opening 130, or the like.

The loading apparatus 100 may further include a base plate 140 removably coupled to a lower opening 119 (shown in FIG. 4) of the housing 110. The lower opening 119 may be defined between lower edges of each of the forward wall 112, the rearward wall 114, and the first and second sidewalls 116, 118. The base plate 140 may be couplable to the housing 110 using fasteners, such as, for example, screws, bolts, or the like.

As illustrated in FIGS. 4-10, the loading apparatus 100 may further include a follower 150 positioned within the housing 110. The follower 150 may include an angled upper surface 152. The loading apparatus 100 may further include a spring 142 positioned within the housing 110 between the base plate 140 and the follower 150. The spring 142 may be configured to apply an upward force 143 (shown in FIGS. 5-10) to the follower 150 towards the upper portion 120 of the housing 110. The spring 142 may be a rectangular spring configured to fit properly within the housing 110 providing even central pressure that applies only as much upward force 143 as necessary to enable the desired functionality of the loading apparatus 100. The spring 142 may be coupled at one end to a lower portion of the follower 150 and further coupled at the other end to a base plate boss 144. The base plate boss 144 may be couplable to an upper surface of the base plate 140 and configured to hold the spring 142 in place, such as, for disassembly, reassembly, and cleaning purposes. In certain optional embodiments, the base plate 140 and the base plate boss 144 may be integrally formed using an injection molded or other manufacturing processes.

The loading apparatus 100 may further include a release mechanism 160 defined on the housing 110 and configured to selectively disengage the upward force 143 of the spring 142 from an uppermost cartridge 20A of the one or more cartridges 20 when received by the housing 110 while maintaining the upward force 143 on the follower 150 and any other cartridges (e.g., 20B, 20C, etc.) of the one or more cartridges 20 when received by the housing 110. The release mechanism 160 may comprise a first cantilevered button 162A integrally formed in the first sidewall 116 of the housing 110 and a second cantilevered button 162B integrally formed in the second sidewall 118 of the housing 110. Each of the first and second cantilevered buttons 162A, 162B may be attached at a lower end to the first or second sidewalls 116, 118, respectively, while the sides and upper end, respectively, may be disconnected from the first and second sidewalls 116, 118. The upward force 143 from the spring 142 may be disengaged from the uppermost cartridge 20A when received by the housing 110 upon engagement of at least one of the first or second cantilevered buttons 162A, 162B. In certain optional embodiments, functionality may be increased by engaging both the first and second cantilevered buttons 162A, 162B simultaneously.

In certain optional embodiments, the release mechanism 160 may be positioned along the forward wall 112 and may be configured to access the second cartridge 20B via the forward opening 130 as an access point. In other optional embodiments, the release mechanism 160 may be positioned along the rearward wall 114 and perform the same functionalities as discussed above.

The upper portion 120 of the housing 110 may include an inner surface 122 having a ramp surface portion 122R and a forward surface portion 122F. The ramp surface portion 122R may be more steeply inclined (or angled) relative to the rearward wall 114 than the forward surface portion 122F. As illustrated in FIGS. 5, 7, 9 and 10, a ramp angle 123R of the ramp surface portion 122R may be between about 105 degrees and about 155 degrees relative to the rearward wall 114 of the housing 110. More particularly, the ramp angle 123R may be between about 125 degrees and about 135 degrees relative to the rearward wall 114 of the housing 110. Still more particularly, the ramp angle 123R may be about 129.4 degrees relative to the rearward wall 114 of the housing 110. In certain optional embodiments, the ramp angle 123R and/or a length of ramp surface portion 122R may vary depending upon the particular caliber of the cartridge for which the loading apparatus 100 is configured to be used with (e.g., the length 28 or the diameter 25 of the rim 24 of the one or more cartridges 20 configured to be received by the loading apparatus 100). A greater ramp angle 123R may not have the needed advance to guide each of the one or more cartridges 20 into the chambers of the cylinder. A lesser ramp angle 123R may make the ramp surface portion 122R too flat producing additional resistance inhibiting a smooth glide as a given cartridge advances up the ramp surface portion 122R. A forward angle 123F of the forward surface portion 122F may be between about 75 degrees and about 125 degrees relative to the rearward wall 114 of the housing 110. More particularly, the forward angle 123F may be between about 95 degrees and about 105 degrees relative to the rearward wall 114 of the housing 110. Still more particularly, the forward angle 123F may be about 99 degrees relative to the rearward wall 114 of the housing 110. In certain optional embodiments, the forward angle 123F and/or a length of forward surface portion 122F may vary depending upon the particular caliber of the cartridge for which the loading apparatus 100 is configured to be used with (e.g., the length 28 or the diameter 25 of the rim 24 of the one or more cartridges 20 configured to be received by the loading apparatus 100). A smaller forward angle 123F may decrease the freedom or ability of the uppermost cartridge 20A to freely fall from the loading apparatus 100 when desired. A larger forward angle 123F may cause the one or more cartridges 20 to over-advance as it moves into the advanced forward position 102.

In certain optional embodiments, as illustrated in FIGS. 4, 5, 7, 9, and 10, the ramp surface portion 122R may include a hard and smooth surface covering 124, such as, for example, plate metal, stainless steel, industrial coating, hard polymer, or the like. The surface covering 124 may be hard in order to resist the impact of the rim 24 of the one or more cartridges 20 positioned within the housing 110. The surface covering 124 may be smooth to reduce the resistance on the one or more cartridges 20 as it slides up and forward. The surface covering 124 may be received within the housing 110 via a slot 125 defined in the rearward wall 114 and retained via friction, press-fit, or the like. The surface covering 124 may be incorporated or installed within the housing 110 differently in other optional embodiments, such as when the housing 110 is manufactured using an injection molding process.

The inner surface 122 of the upper portion 120 may further include an indentation 126 defined between the ramp surface portion 122R and the forward surface portion 122F. The indentation 126 may also be referred to herein as a notch 126. The indentation 126 may be configured to receive a portion of the rim 24 of the uppermost cartridge 20A of the one or more cartridges 20 after the cartridge 20A slides along the ramp surface portion 122R to define an advanced forward position 102 of the uppermost cartridge 20A wherein at least a portion of the uppermost cartridge 20A extends beyond the forward opening 130. The indentation 126 is configured to stop the momentum and keep the uppermost cartridge 20A from over-advancing (e.g., moving forward) along the forward surface portion 122F of the inner surface 122 of the upper portion 120. The indentation 126 is further configured to keep the uppermost cartridge 20A in place during carry, such as, for example, when the loading apparatus 100 is stored in a pocket, on a belt, inside the waistband of a pair of pants, in a bag, or elsewhere.

Figure 5:
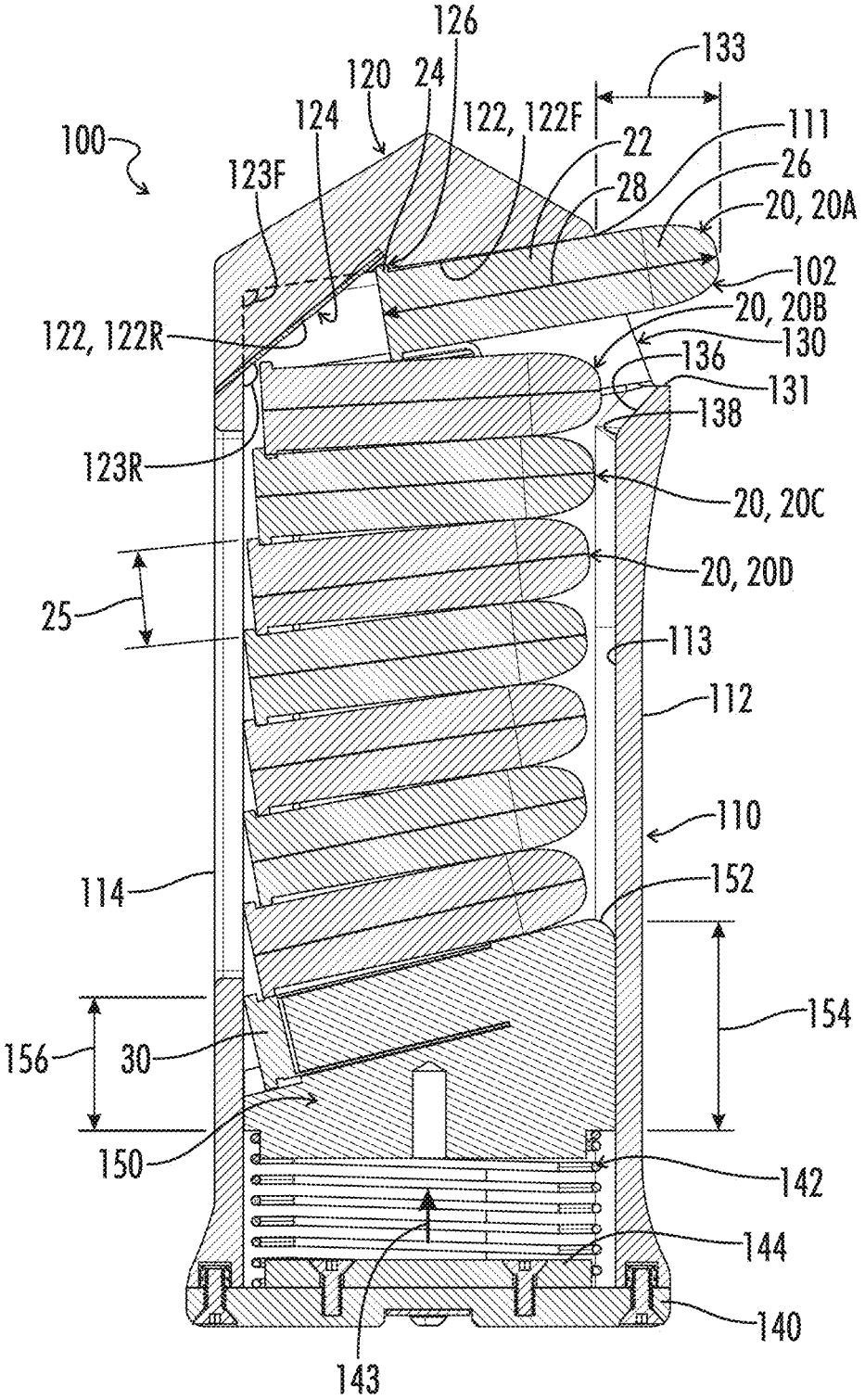
FIG. 5 is a cross-sectional view of the loading apparatus of FIG. 1 taken along line 5-5 of FIG. 2 in accordance with the present disclosure.

The uppermost cartridge 20A, when in the advanced forward position 102, may extend beyond a top edge 111 of the forward opening 130 by an extension distance 133 as illustrated in FIG. 5. In certain optional embodiments, the extension distance 133 may be at least one-quarter (¼) of an inch. Each of the one or more cartridges 20 may include a length 28. In other optional embodiments, at least twenty percent (20%) of the length 28 of the uppermost cartridge 20A may extend beyond the top edge 111 of the forward opening 130 when in the advanced forward position 102. In further optional embodiments, the percent of the length 28 of the uppermost cartridge 20A extending beyond the top edge 111 of the forward opening 130 may be greater than or less than twenty percent (20%), for example, between about ten percent (10%) and about forty percent (40%).

As illustrated in FIGS. 1-4, each of the first and second cantilevered buttons 162A, 162B may include exterior indentations, for example, at an upper portion 164A, 164B, respectively, of the first or second cantilevered buttons 162A, 162B for proper thumb and index finger placement. The user's finger is preferably placed on a central portion of the first or second cantilevered buttons 162A, 162B to properly flex the cantilevered buttons 162A, 162B. The upper portion 164A, 164B, respectively, may also be referred to herein as an upper free end portion 164A, 164B.

Figure 6:
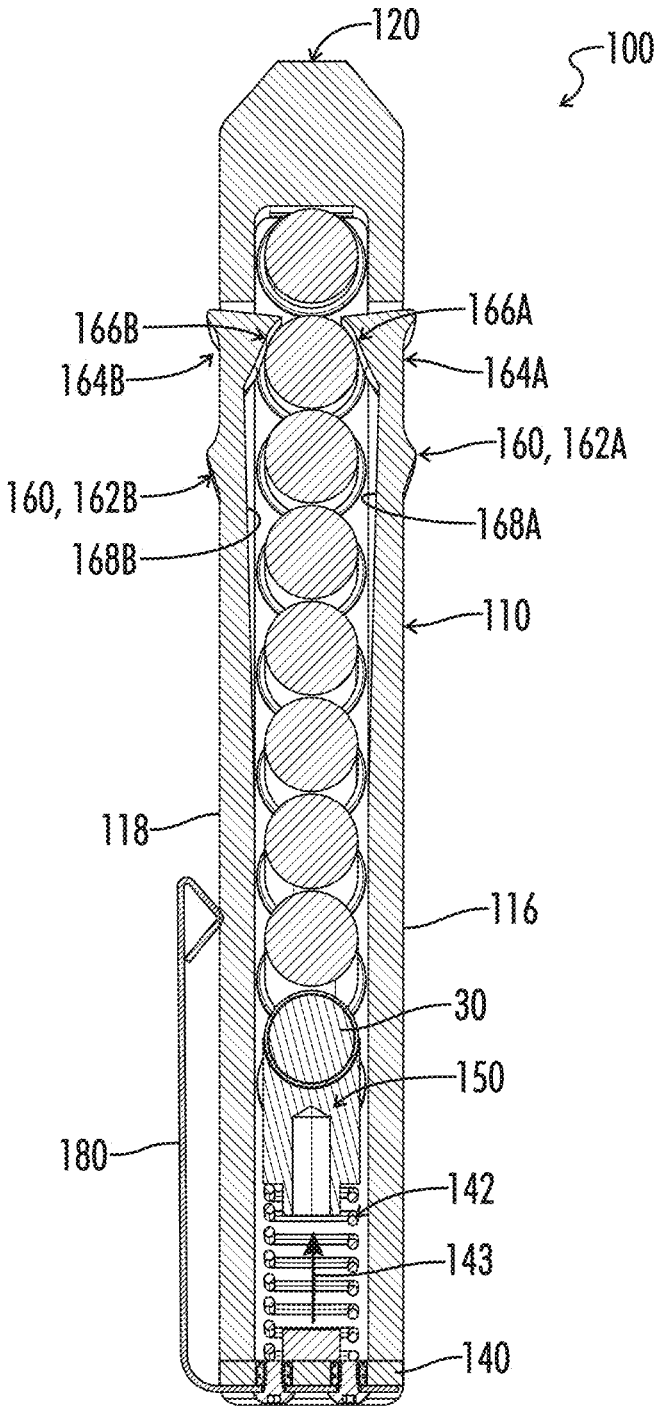
FIG. 6 is a cross-sectional view of the loading apparatus of FIG. 1 taken along line 6-6 of FIG. 2 in accordance with the present disclosure.
Figure 7:
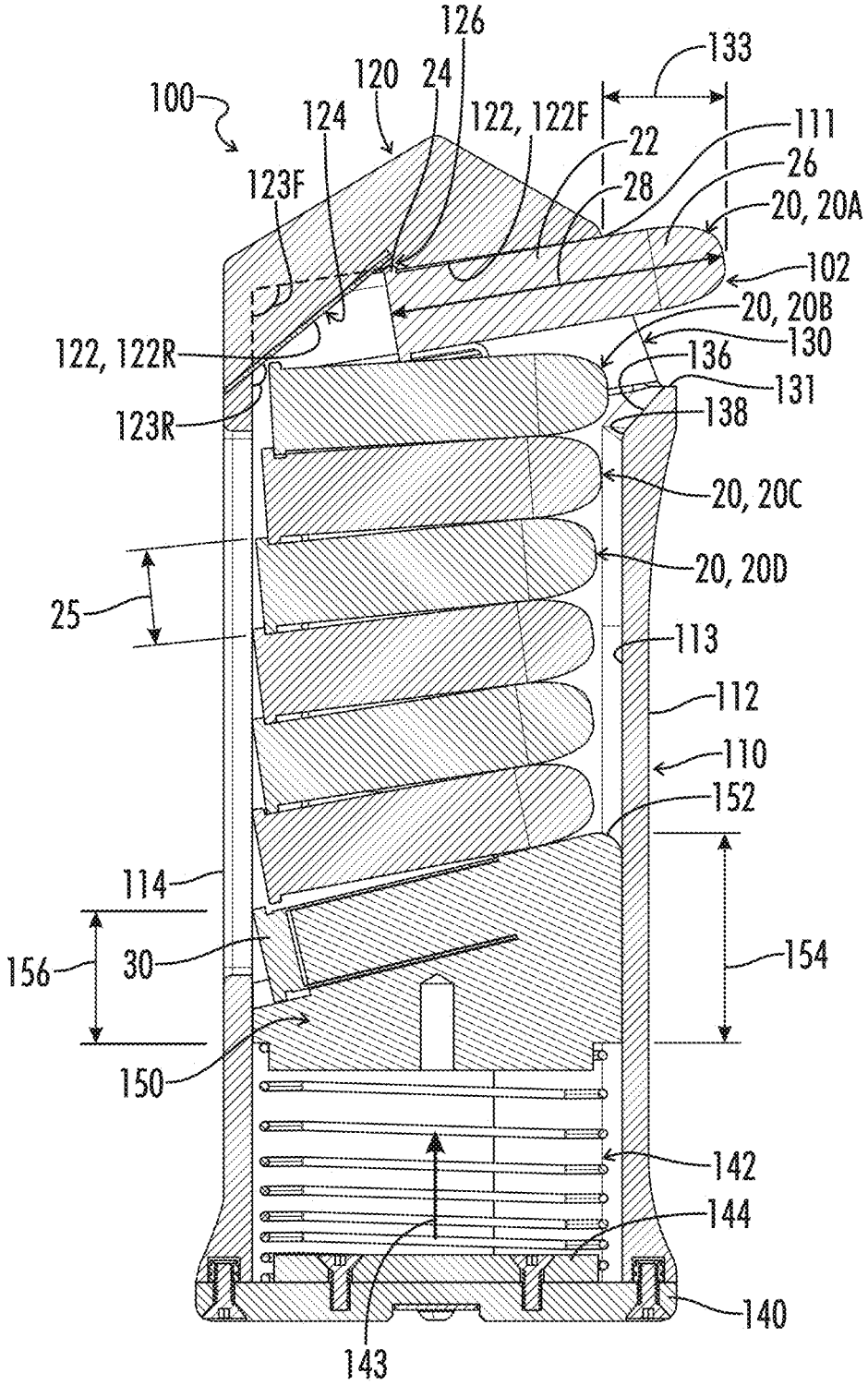
FIG. 7 is a cross-sectional view of the loading apparatus of FIG. 5 with a release mechanism of the loading apparatus engaged in accordance with the present disclosure.
Figure 8:
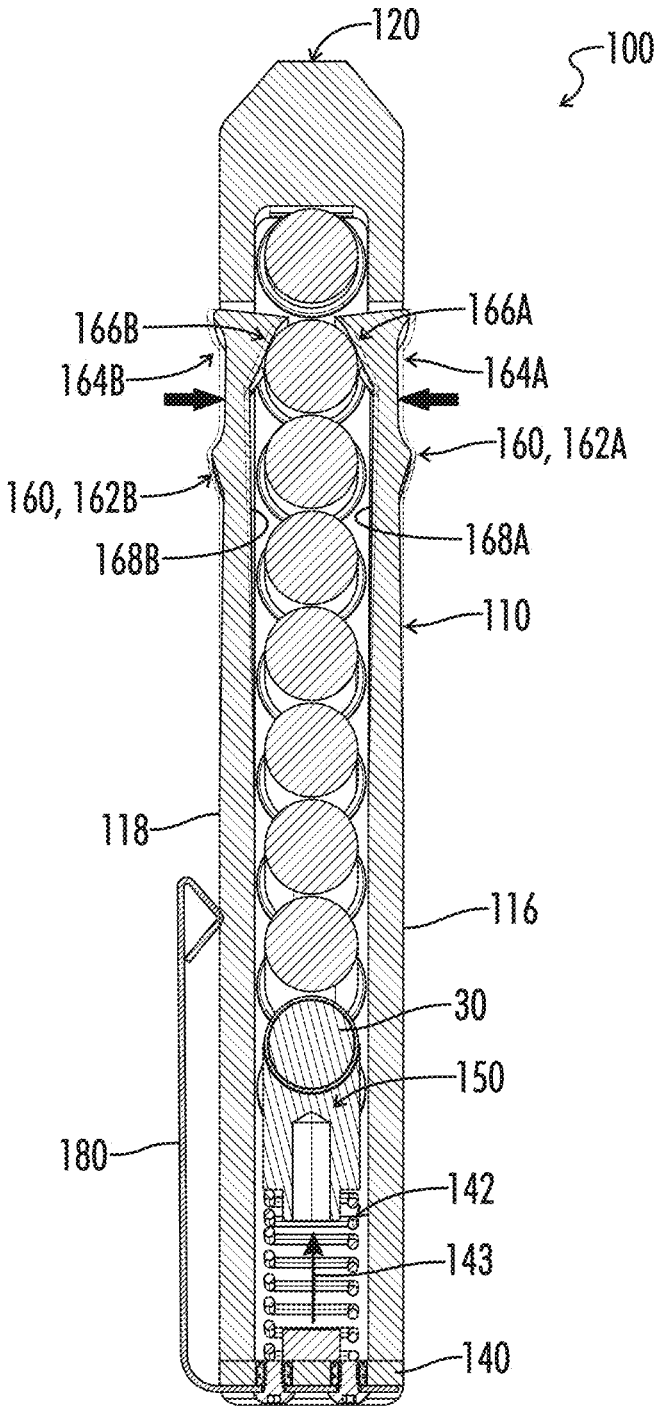
FIG. 8 is a cross-sectional view of the loading apparatus of FIG. 6 with the release mechanism engaged in accordance with the present disclosure.
Figure 9:
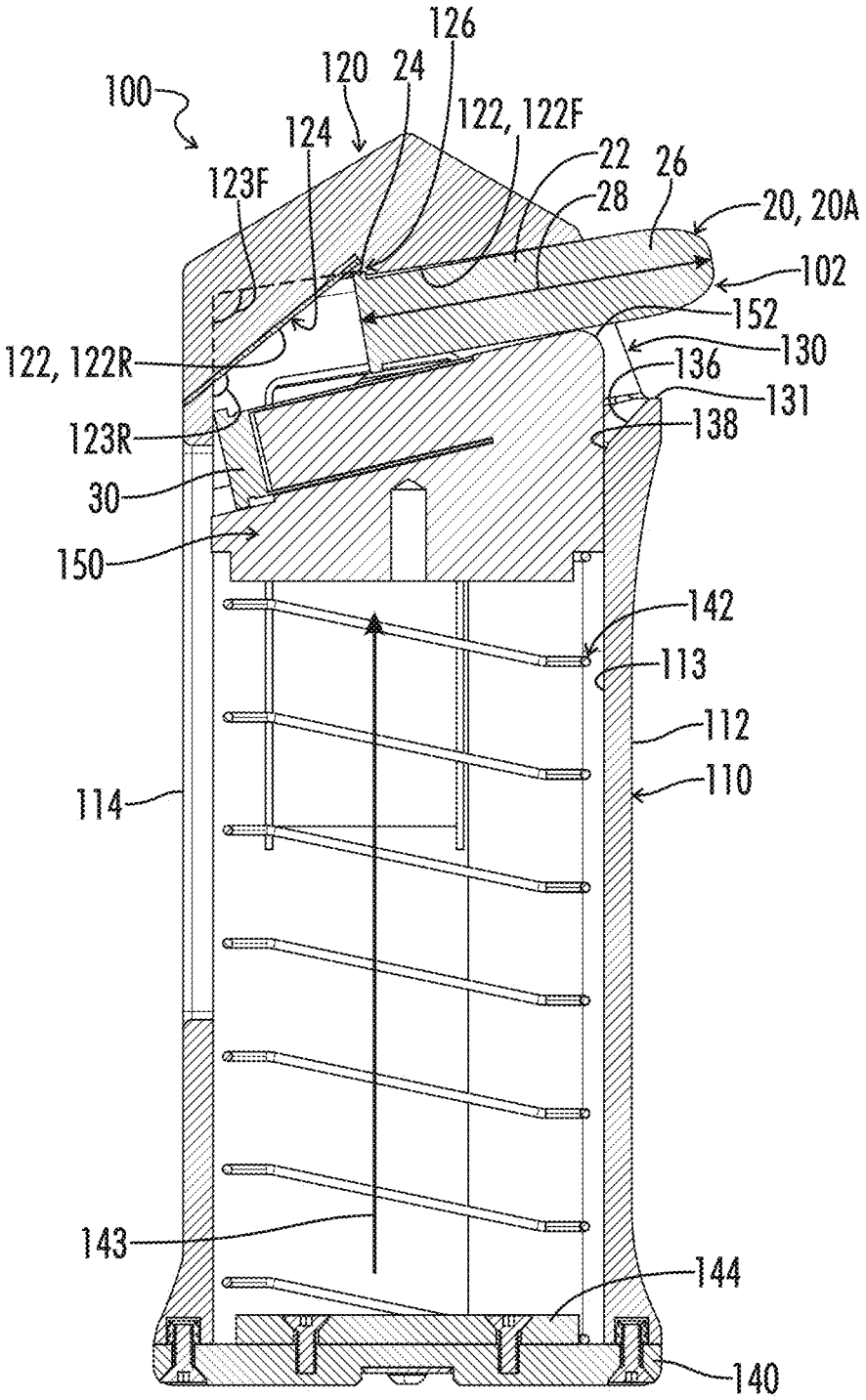
FIG. 9 is a cross-sectional view of the loading apparatus of FIG. 5 with only one cartridge loaded therein in accordance with the present disclosure.
Figure 10:
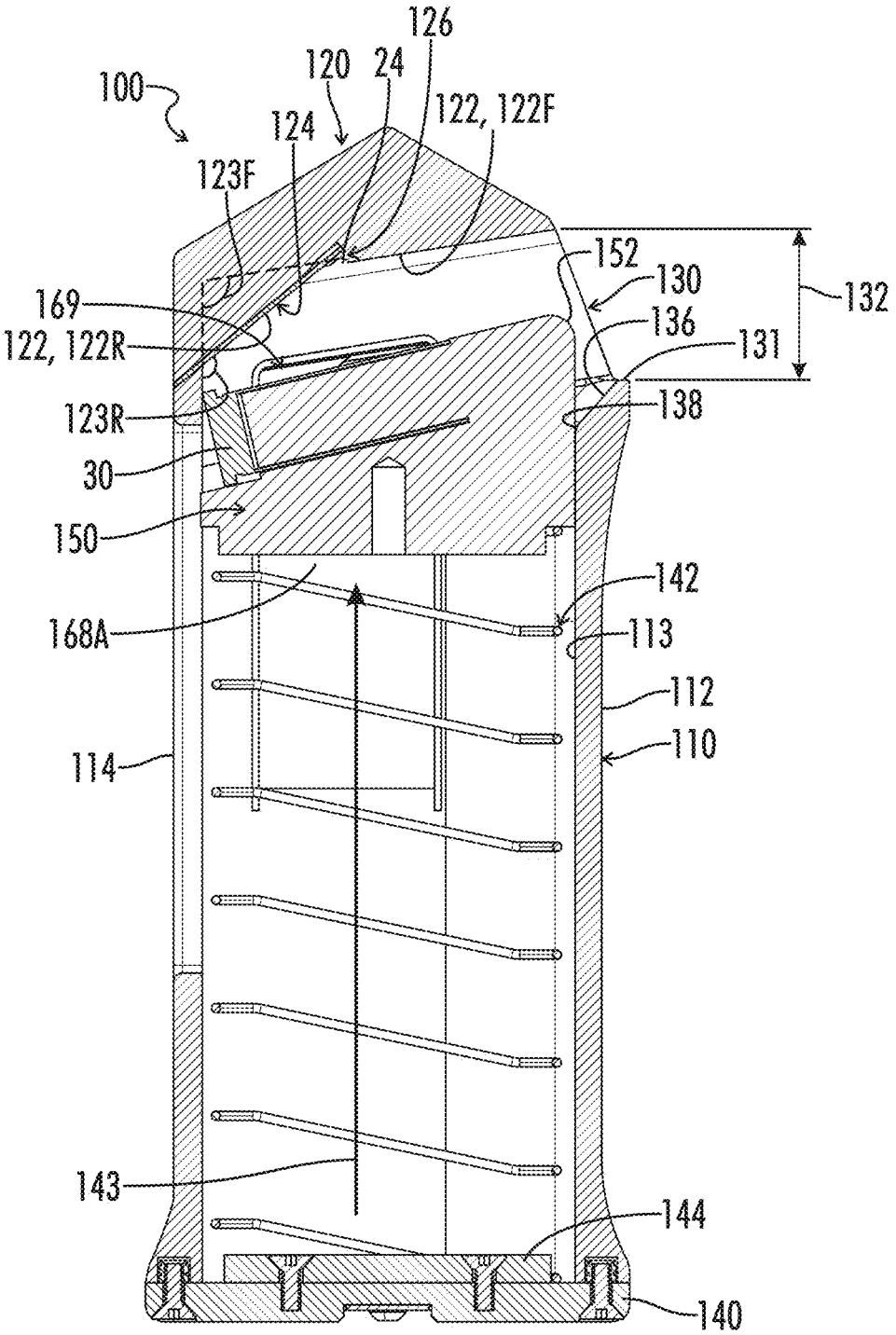
FIG. 10 is a cross-sectional view of the loading apparatus of FIG. 5 empty in accordance with the present disclosure.

As illustrated in FIGS. 6 and 8, each of the first and second cantilevered buttons 162A, 162B may include a boss 166A, 166B, respectively, extending from a respective interior surface 168A, 168B and positioned along the respective upper portion 164A, 164B. The boss 166A, 166B of each of the first and second cantilevered buttons 162A, 162B may be sloped away from the respective interior surface 168A, 168B towards the upper portion 164A, 164B, respectively. In certain optional embodiments, as illustrated in FIG. 10, the boss 166A of the first cantilevered button 162A may not extend along the entire width of the upper portion 164A. As illustrated, each of the first and second cantilevered button 162A, 162B may include an upper rearward cutout portion 169A, 169B, for example, in the shape of a triangle (shown in FIG. 10) with one of its sides parallel to the ramp surface portion 122R. The rear cutout portion 169A, 169B may be co-planar with the interior surface 168A, 168B. While not shown, the second cantilevered button 162B may be configured with a similar rear cutout portion. The rear cutout portion 169A, 169B may ensure that the bosses 166A, 166B do not accidentally interfere with any of the one or more cartridges 20 as they are by received, dispensed from, or move within the loading apparatus 100, which may thereby compromise the performance of the loading apparatus 100. When operated simultaneously, the bosses 166A, 166B may move towards each other in an arcing motion that applies downward force on the second cartridge 20B, while also creating space for gravity to move the uppermost cartridge 20A to properly fall through the forward opening 130.

Figure 2:
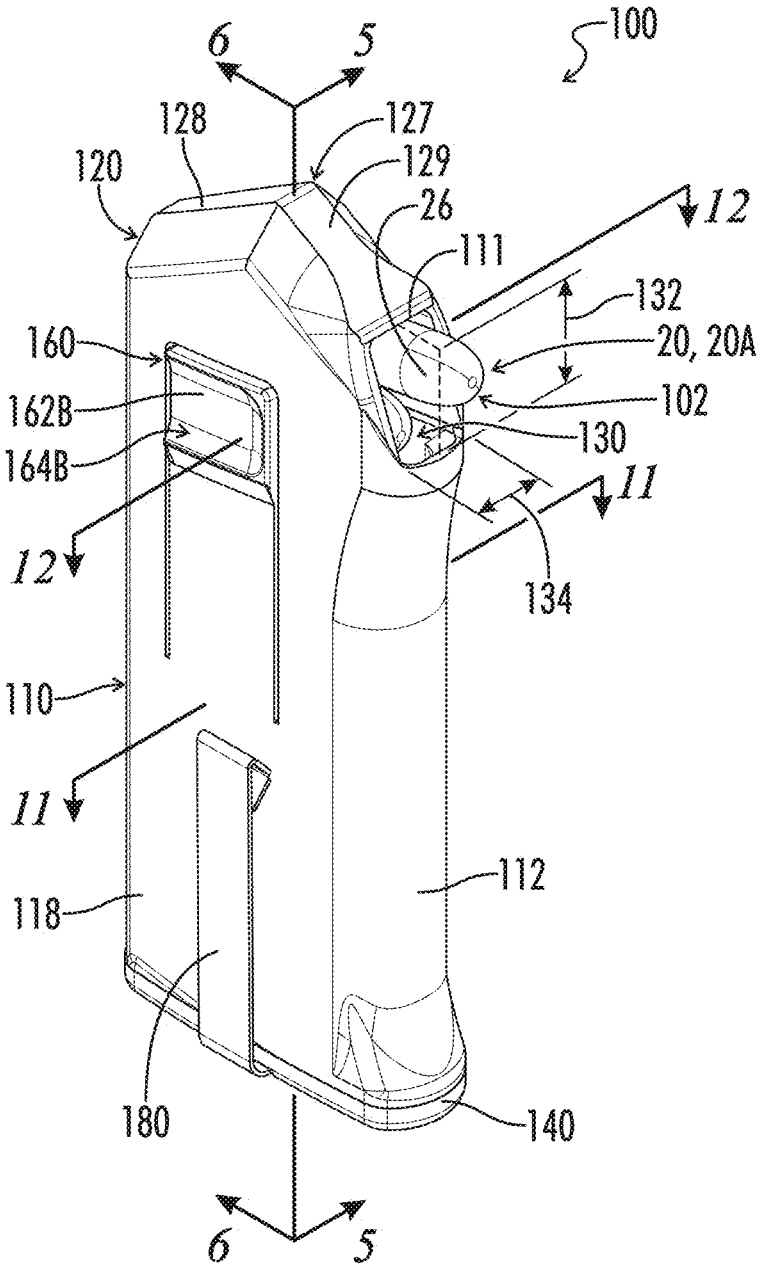
FIG. 2 is a front perspective view of the loading apparatus of FIG. 1 in accordance with the present disclosure.

As illustrated in at least FIG. 2, the forward opening 130 may include an opening height 132 and an opening width 134. The opening width 134 may be greater than the widest portion of the one or more cartridges 20 (i.e., a diameter 25 of the rim 24). The opening width 134 may generally be at least ten percent (10%) greater than the diameter 25 of the rim 24 of the one or more cartridges 20 configured to be received by the loading apparatus 100. Referring now to FIG. 10, the opening height 132 may be greater than the diameter 25 of the rim 24 of the one or more cartridges 20 configured to be received by the loading apparatus 100. The opening height 132 may be in a range of from 0.4 inches to 0.9 inches, preferably in a range of from 0.5 to 0.8 inches, and most preferably in a range of from 0.6 to 0.7 inches. If the opening height 132 is too small, then the uppermost cartridge 20A might not advance properly after the release mechanism 160 is engaged. The uppermost cartridge 20A also might not fall freely when the release mechanism 160 is engaged. If the opening height 132 is too large, then the second cartridge 20B of the one or more cartridges 20 immediately following (or below) the uppermost cartridge 20A may unintentionally advance with the uppermost cartridge 20A after the release mechanism 160 is engaged. The size of the opening also aids in loading the device. If the opening height 132 is too small, the loading apparatus 100 may not properly receive the one or more cartridges 20 against the ramp surface portion 122R.

In certain optional embodiments, as illustrated in FIGS. 5, 7, 9, and 10, the housing 110 may further include a forward ramp 136 defined between an interior surface 113 of the forward wall 112 and a lower edge 131 of the forward opening 130. The forward ramp 136 may be configured to guide the second cartridge 20B positioned immediately below the uppermost cartridge 20A back towards the rearward wall 114 when the release mechanism 160 is engaged. Without the forward ramp 136, the tip 26 of the second cartridge 20B may bind up on the lower edge 131 of the forward opening 130 when the release mechanism 160 is engaged.

The housing 110 may further include a ramp joint 138 defined between the forward ramp 136 and the inner surface 113 of the forward wall 112. The ramp joint 138 may be configured to extend the forward inner surface 113 as far as possible and deny premature access to the forward ramp 136. This prevents forward movement of the second cartridge 20B after the release mechanism 160 is engaged during a momentary loss of spring pressure. The ramp joint 138 may be shaped more sharply and less arcuate so as to better extend the forward inner surface 113 and engage the second cartridge 20B.

The angled upper surface 152 of the follower 150 may be angled between about seventy (70) degrees and about eighty-two (82) degrees from the rearward wall 114 such that the angled upper surface 152 is angled upwards from the rearward wall 114 towards the forward wall 112. In certain optional embodiments, the angle of the angled upper surface 152 may be less than seventy (70) degrees or greater than eighty-two (82) degrees. In other optional embodiments, the angled upper surface 152 may be angled at about 76.5 degrees from the rearward wall 114. In further optional embodiments, the angle of the angled upper surface 152 and/or a length of angled upper surface 152 may vary depending upon the particular caliber of the cartridge for which the loading apparatus 100 is configured to be used with (e.g., the length 28 or the diameter 25 of the rim 24 of the one or more cartridges 20 configured to be received by the loading apparatus 100).

In certain optional embodiments, the angled upper surface 152 of the follower 150 may be at least partially defined by the casing 22 of an empty cartridge 30 similar to that of the one or more cartridges 20. This simulates the follower 150 being like an additional cartridge below a final cartridge 20N of the one or more cartridges 20 when dispensed by the housing 110. In other optional embodiments, the angled upper surface 152 may include a hard covering, such as, for example, a metal covering, hard smooth polymer (such as carbon fiber reinforced nylon), hard smooth coating (such as a ceramic coating), or be made out of a hard smooth metal. A forward height 154 of the follower 150 may be greater than the opening height 132 of the forward opening 130 so as to prevent the follower 150 from advancing out the forward opening 130. The forward height 154 of the follower 150 also stabilizes the follower 150 such that the follower 150 moves within the housing without rocking forward and backward. The ratio between the forward height 154 of the follower 150 and a rearward height 156 of the follower 150 is in a range of from 1.1:1 to 1.6:1, preferably from 1.2:1 to 1.5:1, and most preferably from 1.3:1 to 1.4:1.

Figure 3:
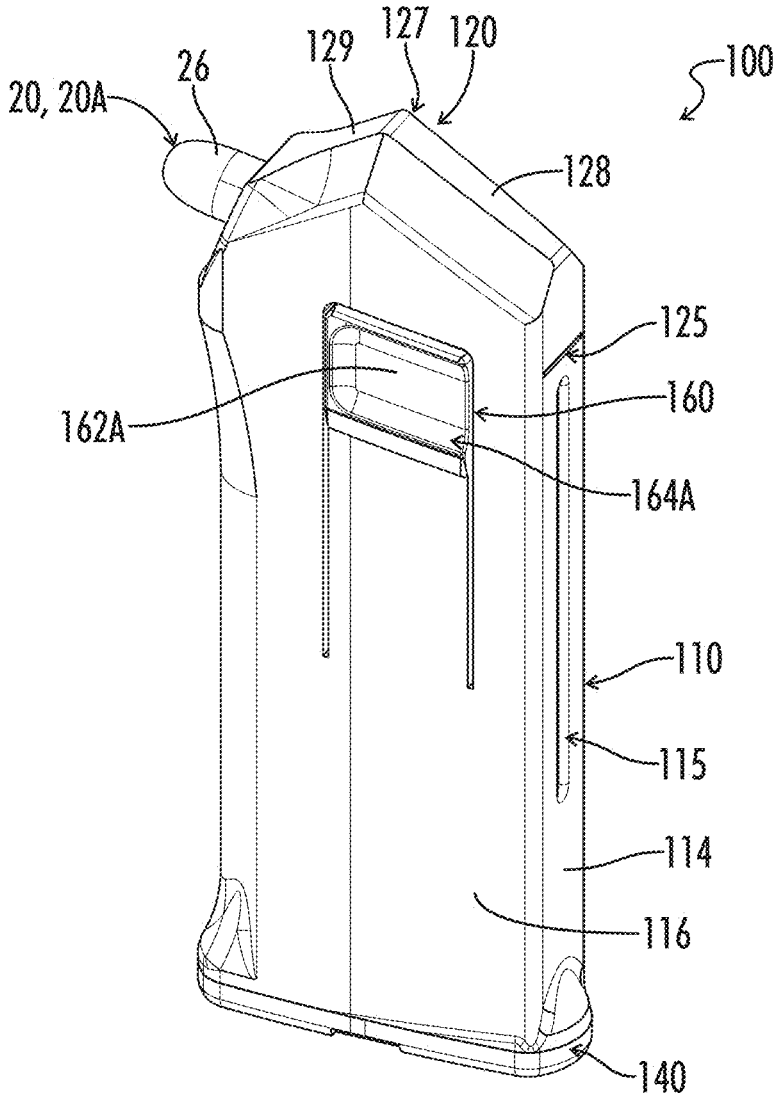
FIG. 3 is a rear perspective view of the loading apparatus of FIG. 1 in accordance with the present disclosure.
Figure 4:
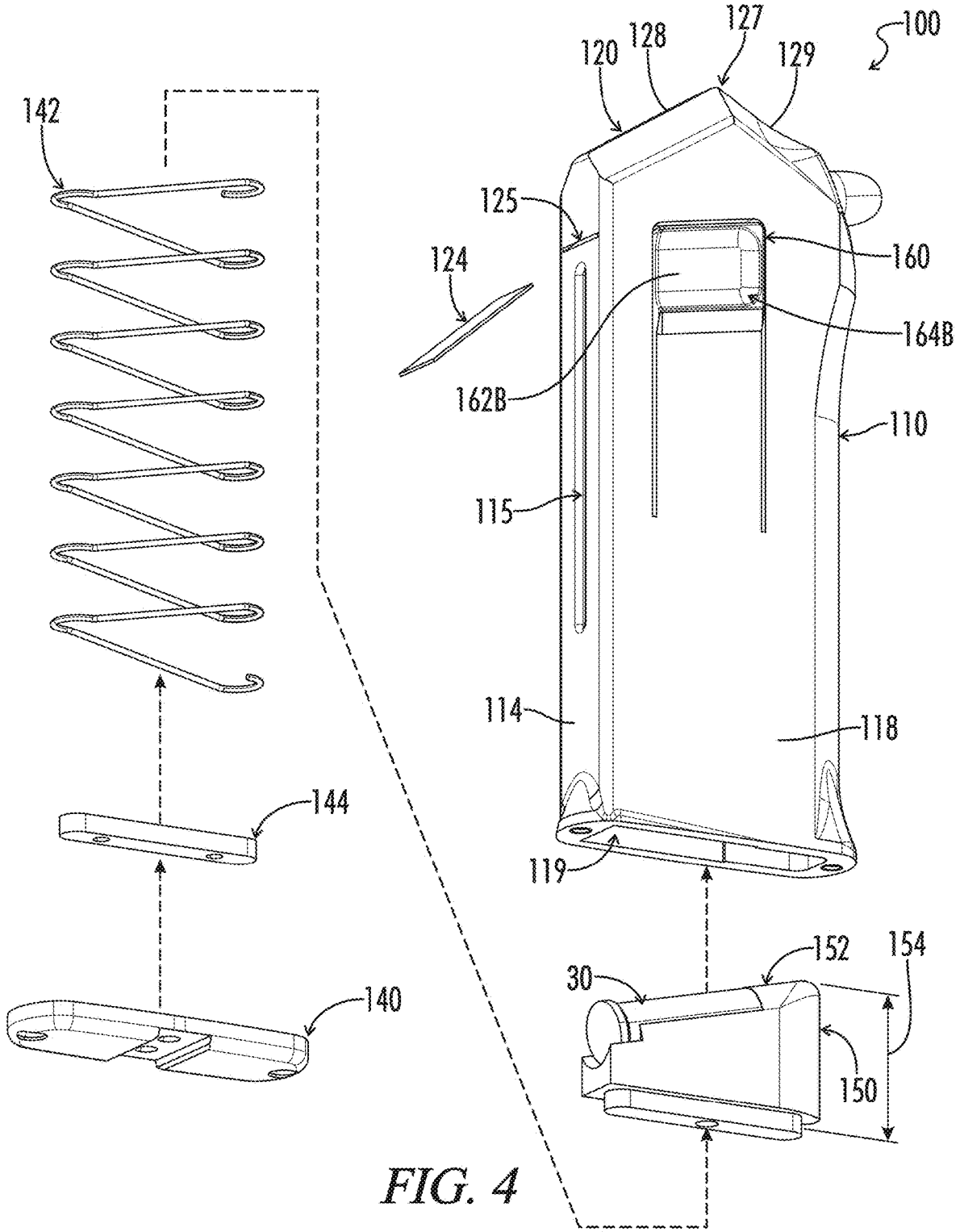
FIG. 4 is an exploded perspective view of the loading apparatus of FIG. 1 in accordance with the present disclosure.

As illustrated in FIGS. 3 and 4, the rearward wall 114 may further include an elongated sight opening 115. The elongated sight opening 115 may enable a user to quickly count how many cartridges of the one or more cartridges 20 are positioned within the housing 110. The elongated sight opening 115 may enable a user to ensure that a "rim lock" has not occurred during the process of loading the loading apparatus 100 with the one or more cartridges 20. A "rim lock" occurs when a rim of a given cartridge is positioned behind the rim of the immediately following (below) cartridge, thus preventing the "upper" locked cartridge from being dispensed out of the loading apparatus 100. To clear a "rim lock" simply strike the base plate 140 with the advanced round facing vertically straight down. This will break the spring tension for a fraction of a second, being long enough for gravity to let the rim fall free, but not so long that the cartridge falls from the apparatus 100. At this point, the cartridge sits in the advanced forward position 102, the malfunction has been cleared, and the apparatus 100 is ready for normal use. Clearing a rim lock and "checking the stack" is only part of the loading procedure. After the apparatus 100 is loaded, the apparatus 100 operates reliably.

As illustrated in at least FIG. 2, the loading apparatus 100 may further include a clip 180 which may be coupled to the base plate 140. The clip 180 may be attached to extend along either of the first or second sidewalls 116, 118 of the housing 110. Accordingly, the clip 180 is ambidextrous. Similarly, due to the symmetry of the first and second cantilevered buttons 162A, 162B, the loading apparatus 100 may also be completely ambidextrous. The clip 180 may accommodate belt, inside the waistband (IWB), or pocket carry of the loading apparatus 100.

As illustrated, the upper portion 120 of the housing 110 may be closed, however, in other optional embodiments, the upper portion 120 may be partially closed (or partially open) similar to a typical firearm magazine. The upper portion of the housing 120 may further include a first angled exterior surface 128 extending from the rearward wall 114 and a second angled exterior surface 129 angled downwardly from the first angled exterior surface 128 towards the forward opening 130. The first and second angled exterior surfaces 128, 129 may define a strike cap 127 of the loading device 100, thus enabling the loading device 100 to further be useful for hand-to-hand personal protection. The loading apparatus 100 may fill a user's first while also making the first heavier. The strike cap 127 feature does not work on the bottom because a strike using the base plate 140 breaks the upward force 143 of the spring 142, thus allowing the one or more cartridges 20 positioned within the housing 110 to become jumbled.

Figure 11:
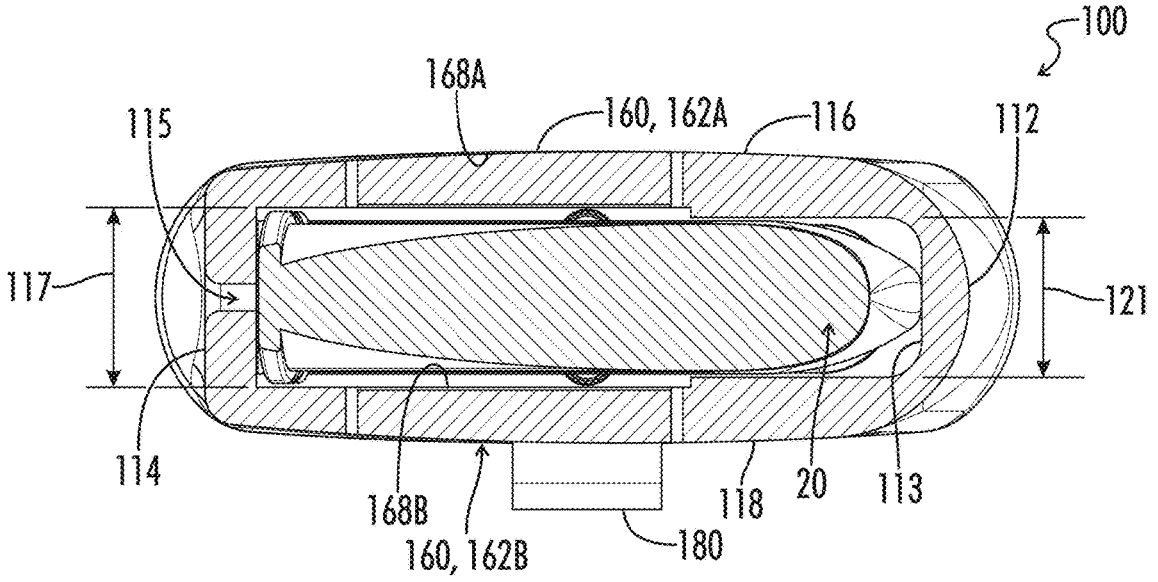
FIG. 11 is a is a cross-sectional view of the loading apparatus of FIG. 1 taken along line 11-11 of FIG. 2 in accordance with the present disclosure
Figure 12:
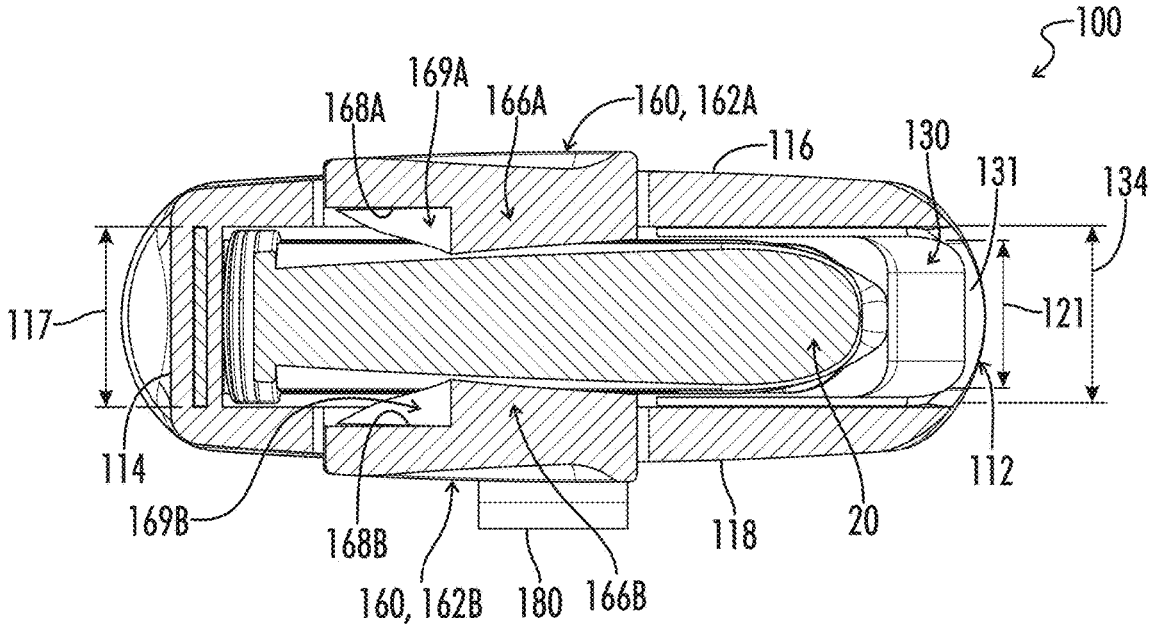
FIG. 12 is a cross-sectional view of the loading apparatus of FIG. 1 taken along line 12-12 of FIG. 2 in accordance with the present disclosure

The loading apparatus 100 may be specifically designed and sized for different revolver calibers (e.g., the one or more cartridges 20), such as, but not limited to 38 special, 327 magnum, 357 magnum, 44 magnum, or the like. Because most revolver calibers have a cartridge that includes the rim 24, the inside of the housing 110 may be wider in the back and narrower in the front. As such, in certain optional embodiments, as illustrated in FIG. 11, a width 117 of the inner surface of the rearward wall 114 may be greater than a width 121 of the inner surface 113 of the forward wall 112. This may provide for a tighter fit of the one or more cartridges 20 in a straight vertical stack within the housing 110, while also minimizing rattling of the one or more cartridges 20 due to side-to-side movement. Noise reduction is always an important aspect when it comes to concealability and personal protection. As illustrated in FIG. 12, the width 117 of the rearward wall 114 may be equal to the opening width 134 of the forward opening 130. As such, in certain optional embodiments, the first and second sidewalls 116, 118 may be angled relative to each other, include parallel stepped portions, some combination thereof, or the like.

Figure 13:
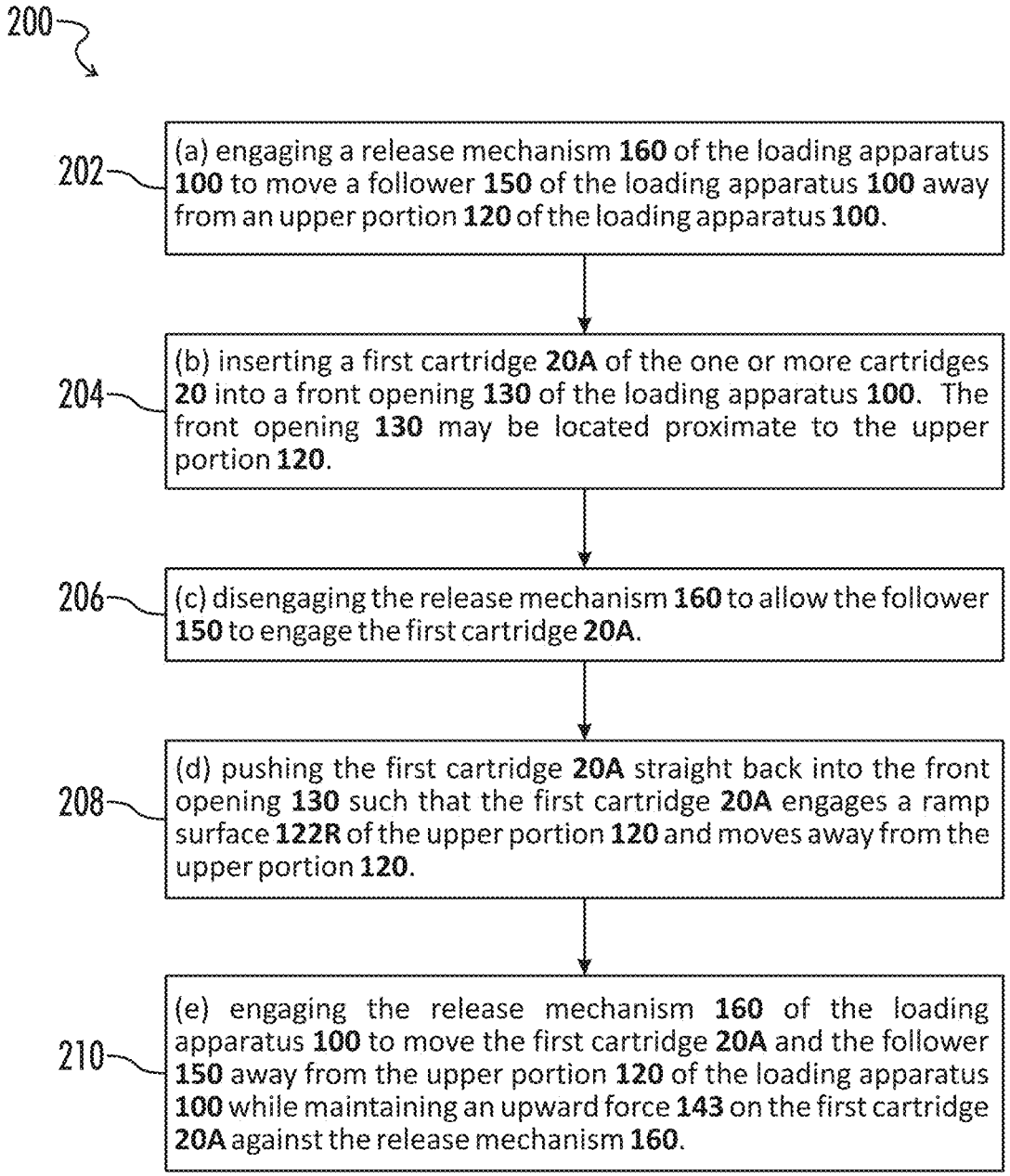
FIG. 13 is a flow diagram of a method of loading one or more cartridges into the loading apparatus of FIG. 1 in accordance with the present disclosure.

Referring to FIG. 13, a method 200 of loading one or more cartridges 20 into the loading apparatus 100. The method 200 may include (a) engaging 202 a release mechanism 160 of the loading apparatus 100 to move a follower 150 of the loading apparatus 100 away from an upper portion 120 of the loading apparatus 100. The method 200 may further include (b) inserting 204 a first cartridge 20A of the one or more cartridges 20 into a front opening 130 of the loading apparatus 100. The front opening 130 may be located proximate to the upper portion 120. The method 200 may further include (c) disengaging 206 the release mechanism 160 to allow the follower 150 to engage the first cartridge 20A. The method 200 may further include (d) pushing 208 the first cartridge 20A straight back into the front opening 130 such that the first cartridge 20A engages a ramp surface portion 122R of the upper portion 120 and moves away from the upper portion 120. The method 200 may further include (e) engaging 210 the release mechanism 160 of the loading apparatus 100 to move the first cartridge 20A and the follower 150 away from the upper portion 120 of the loading apparatus 100 while maintaining an upward force 143 on the first cartridge 20A against the release mechanism 160.

The method 200 may further comprise repeating steps (b) through (e) for each additional cartridge of the one or more cartridges 20.

Figure 14:
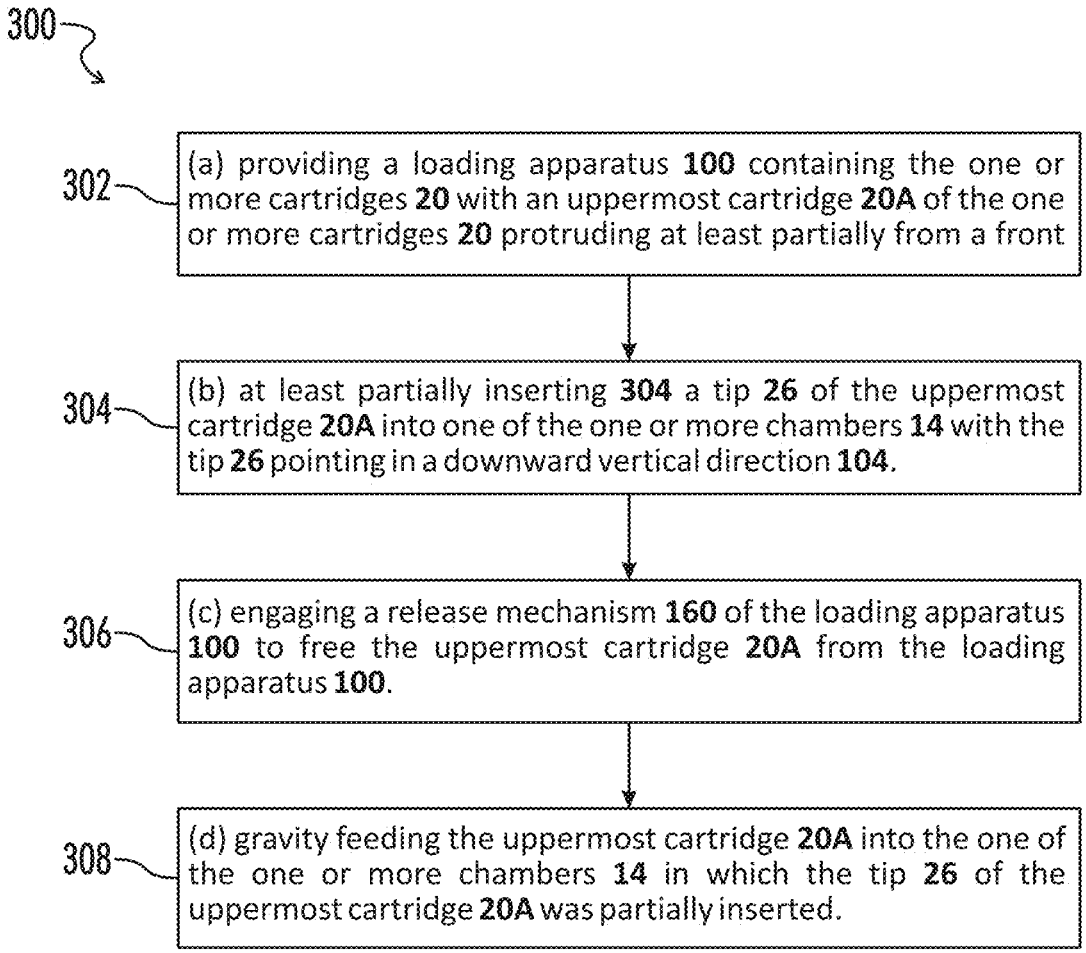
FIG. 14 is a flow diagram of a method of loading one or more cartridges into one or more chambers of a cylinder of a revolver using the loading apparatus of FIG. 1 in accordance with the present disclosure.
Figure 15A:
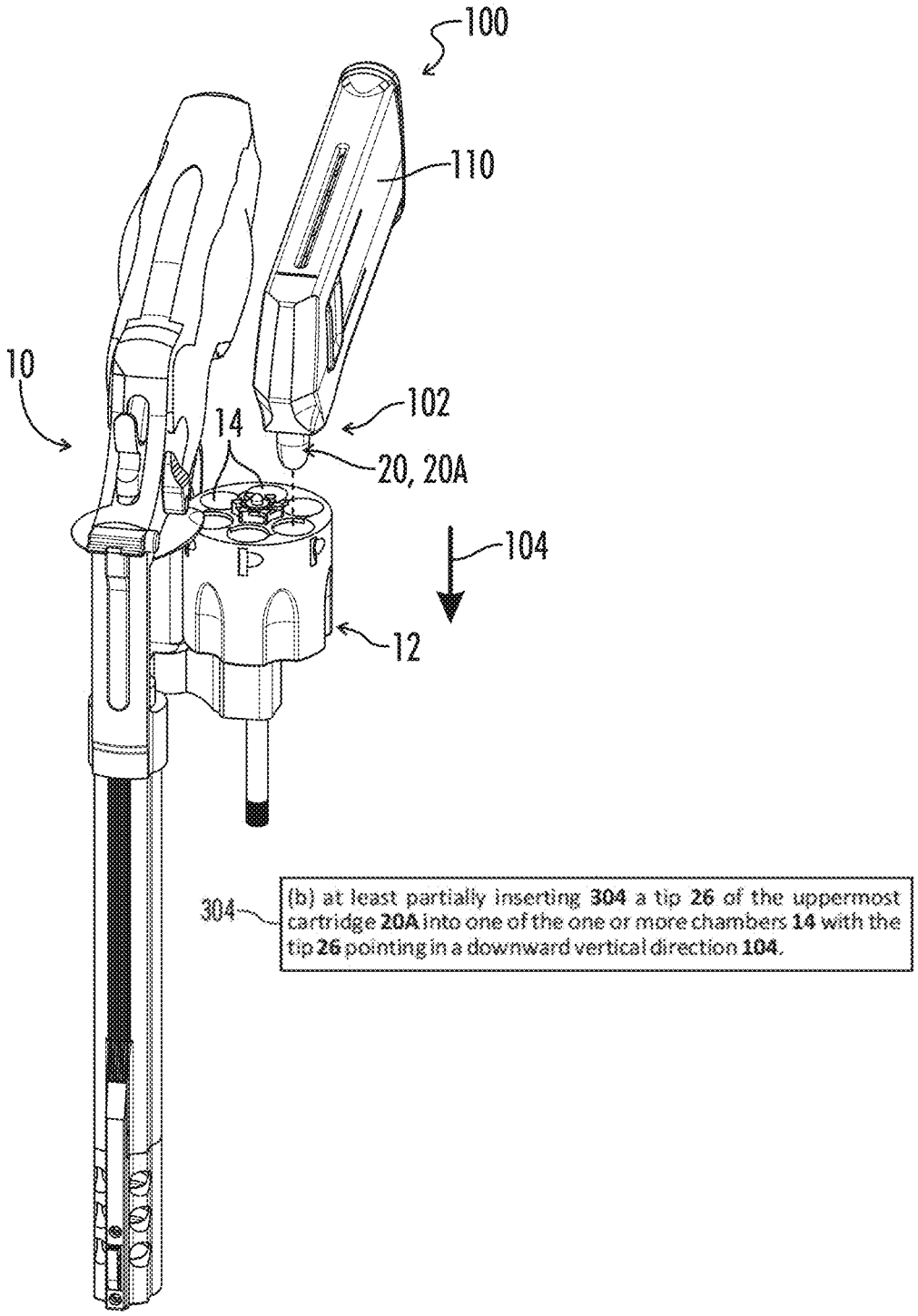
FIG. 15B illustrates the method shown in the flow diagram of FIG. 14 regarding a step of at least partially inserting a cartridge.
FIG. 15C illustrates the method shown in the flow diagram of FIG. 14 regarding a step of gravity feeding a cartridge.
Figure 15B:
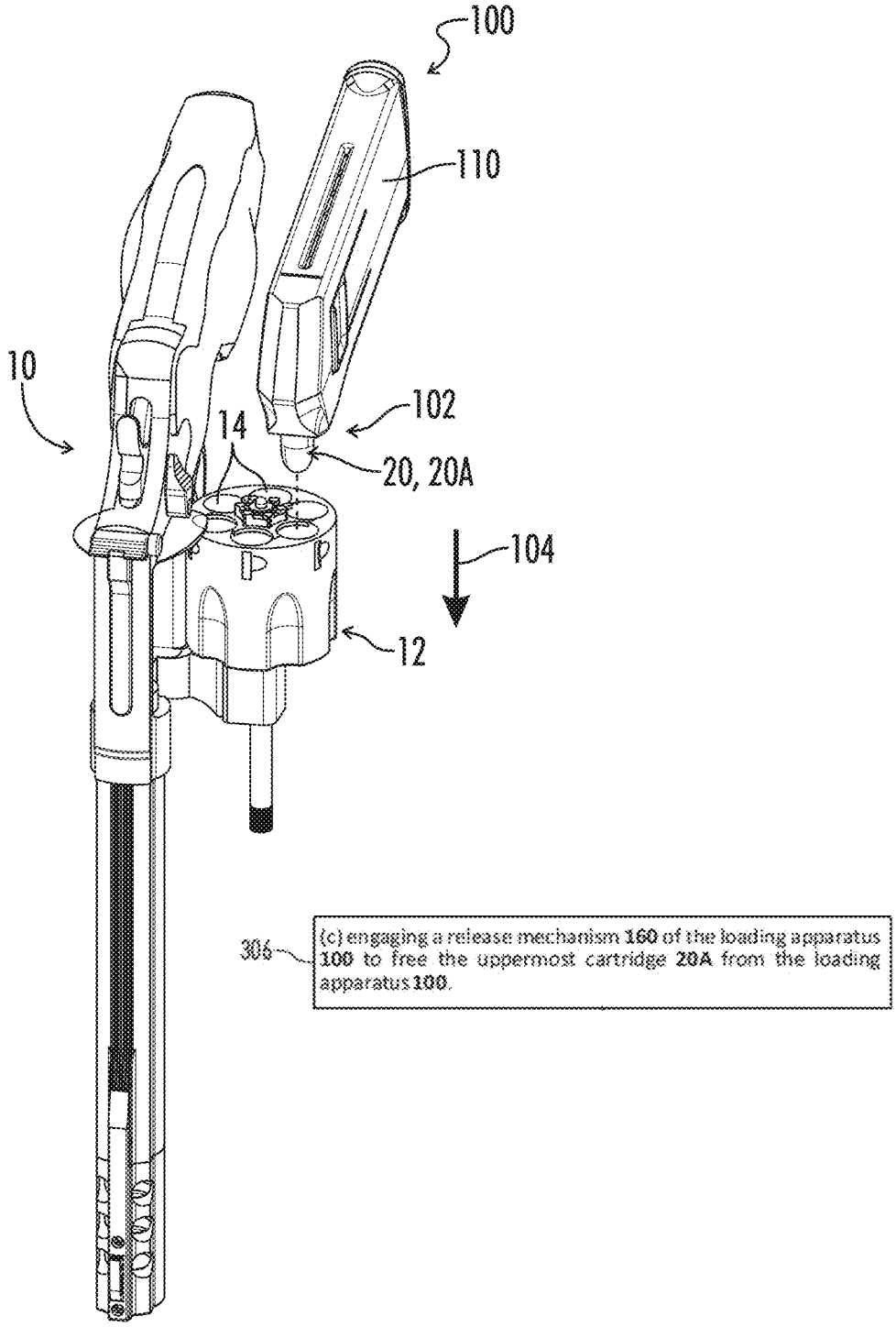
Figure 15C:
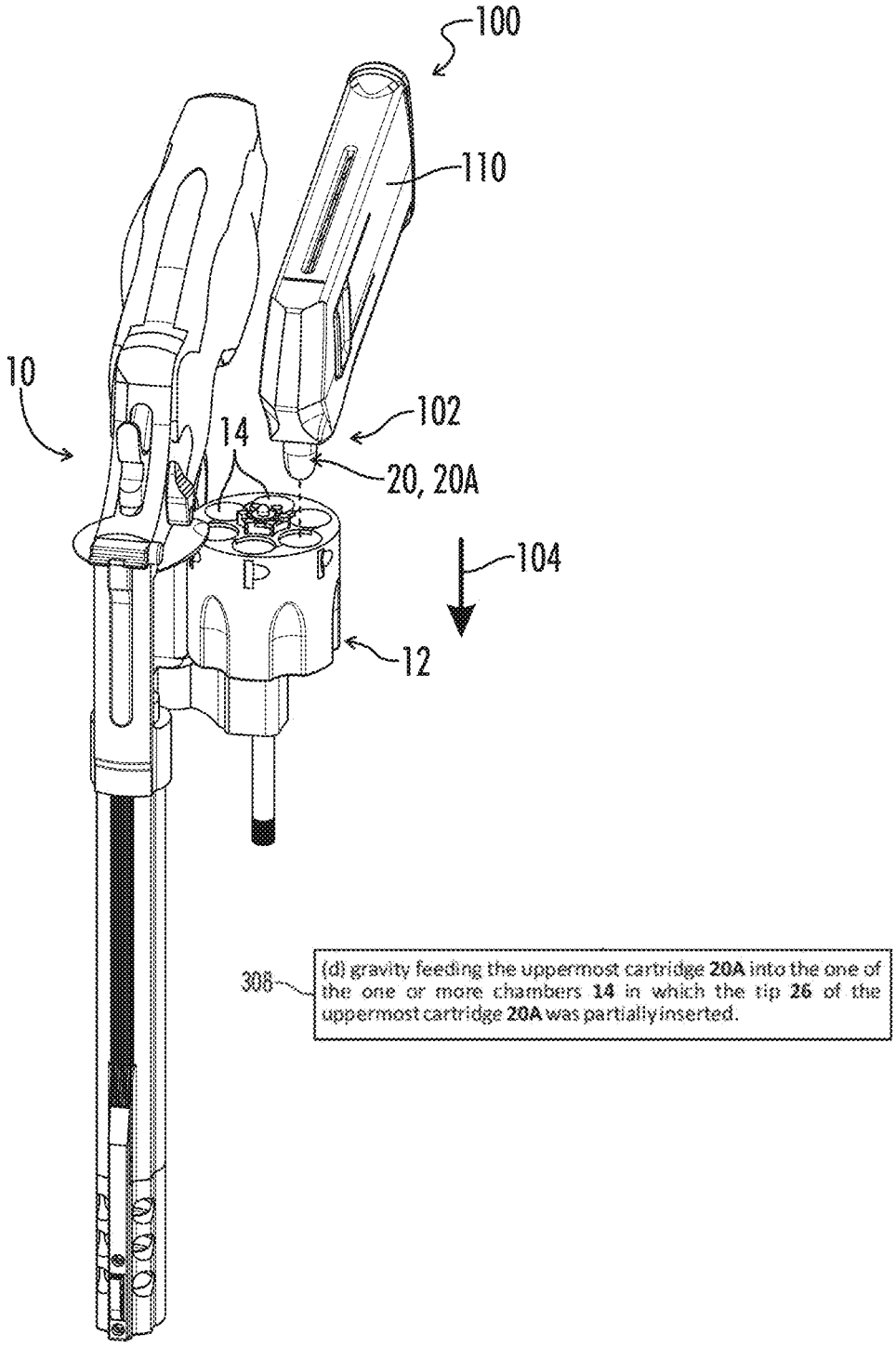

Referring to FIG. 14, a method 300 of loading one or more cartridges 20 into one or more chambers 14 of a revolver 10. The one or more chambers 14 may be positioned within a cylinder 12 of the revolver 10. The method 300 may include (a) providing 302 a loading apparatus 100 containing the one or more cartridges 20 with an uppermost cartridge 20A of the one or more cartridges 20 protruding at least partially from a front upper opening 130 of the loading apparatus 100 to define an advanced forward position 102 of the uppermost cartridge 20A. The method 300 may further include (b) at least partially inserting 304 a tip 26 of the uppermost cartridge 20A into one of the one or more chambers 14 with the tip 26 pointing in a downward vertical direction 104, as shown in FIG. 1 (e.g., towards a ground or support surface). The method 300 may further include (c) engaging 306 a release mechanism 160 of the loading apparatus 100 to free the uppermost cartridge 20A from the loading apparatus 100. The method 300 may further include (d) gravity feeding 308 the uppermost cartridge 20A into the one of the one or more chambers 14 in which the tip 26 of the uppermost cartridge 20A was partially inserted.

Step (c) of the method 300 may further include disengaging a compressive upward force 143 from the uppermost cartridge 20A while maintaining the upward force 143 on all of the one or more cartridges 20 positioned between the follower 150 of the loading apparatus 100 and the release mechanism 160.

The method 300 may further comprise disengaging the release mechanism 160 to allow a following cartridge 20B of the one or more cartridges 20 to move upward into the advanced forward position 102 such that it is received by an indentation; and repeating steps (b) through (d) for each following cartridge when in the advanced forward position 102 and for each ones of the one or more chambers 14 of the revolver 10.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The previous detailed description has been provided for the purposes of illustration and description. Thus, although there have been described particular embodiments of a new and useful invention, it is not intended that such references be construed as limitations upon the scope of this disclosure except as set forth in the following claims.

What is claimed is:

1. A loading apparatus for a revolver, the loading apparatus comprising:

a housing including a forward wall, a rearward wall, first and second sidewalls extending between the forward wall and the rearward wall, an upper portion, and a forward opening defined between the forward wall and the upper portion;

a follower positioned within the housing and including an angled upper surface;

a spring positioned within the housing and configured to apply an upward force to the follower towards the upper portion of the housing; and a release mechanism defined on the housing, the release mechanism configured to selectively disengage the upward force of the spring from an uppermost cartridge of one or more cartridges when received by the housing while maintaining the upward force on the follower and any other cartridges of the one or more cartridges when received by the housing, wherein the housing includes a forward ramp defined between an inner surface of the forward wall and a lower edge of the forward opening; and wherein the forward ramp is configured to guide a second cartridge of the one or more cartridges positioned immediately below the uppermost cartridge when received by the housing back towards the rearward wall when the release mechanism is engaged.

2. The loading apparatus of claim 1, wherein:

an inner surface of the upper portion includes a ramp surface portion and a forward surface portion, the ramp surface portion is more steeply angled relative to the rearward wall than the forward surface portion.

3. The loading apparatus of claim 2, wherein:

the ramp surface portion includes a smooth surface covering configured to reduce resistance on a cartridge of the one or more cartridges as it the cartridge slides up and forward along the smooth surface covering of the ramp surface portion.

4. The loading apparatus of claim 2, wherein:

a ramp angle of the ramp surface portion is between about 125 degrees and about 135 degrees relative to rearward wall of the housing; and a forward angle of the forward surface portion is between about 95 degrees and about 105 degrees relative to the rearward wall of the housing.

5. The loading apparatus of claim 2, wherein:

the inner surface of the upper portion further includes an indentation defined between the ramp surface portion and the forward surface portion; and the indentation is configured to receive a portion of a rim of the uppermost cartridge of the one or more cartridges when received by the housing to define an advanced forward position of the uppermost cartridge.

6. The loading apparatus of claim 5, wherein:

at least 20 percent of a length of the uppermost cartridge of the one or more cartridges when received by the housing extends beyond a top edge of the forward opening of the housing when in the advanced forward position.

7. The loading apparatus of claim 5, wherein:

the uppermost cartridge of the one or more cartridges when received by the housing extends beyond a top edge of the forward opening of the housing by at least one-quarter of an inch when in the advanced forward position.

8. The loading apparatus of claim 1, wherein:

the upper portion of the housing is closed and includes at least a first angled exterior surface extending from the rearward wall and a second angled exterior surface angled downwardly from the first angled exterior surface towards the forward opening; and the first and second angled exterior surfaces define a strike cap for personal protection purposes.

9. The loading apparatus of claim 1, wherein:

the release mechanism includes a first cantilevered button integrally formed in the first sidewall of the housing and a second cantilevered button integrally formed in the second sidewall of the housing; and the upward force of the spring is disengaged from the uppermost cartridge of the one or more cartridges received by the housing upon engagement of at least one of the first or second cantilevered buttons.

10. The loading apparatus of claim 9, wherein:

each of the first and second cantilevered buttons includes a boss extending from an interior surface of the first or second cantilevered button, respectively.

11. The loading apparatus of claim 10, wherein:

the boss of each of the first and second cantilevered buttons is sloped away from the interior surface towards an upper free end portion of the first or second cantilevered button, respectively.

12. The loading apparatus of claim 1, wherein:

the angled upper surface of the follower is angled between about 70 degrees and about 82 degrees from the rearward wall such that the angled upper surface is angled upward towards the forward wall.

13. The loading apparatus of claim 1, wherein:

an opening height of the forward opening may be in a range of from 0.4 inches to 0.9 inches.

14. The loading apparatus of claim 1, wherein:

a ramp joint is defined between the forward ramp and the inner surface of the forward wall; and the ramp joint is configured to prevent forward movement of the second cartridge after engagement of the release mechanism.

15. The loading apparatus of claim 1, wherein:

the follower includes a forward surface having a forward height and a rearward surface having a rearward height;

wherein the ratio between the forward height and the rearward height is in a range of from 1.1:1 to 1.6:1.

16. A method of loading one or more cartridges into one or more chambers of a cylinder of a revolver using the loading apparatus of claim 1, the method comprising the steps of:

(a) providing the loading apparatus containing the one or more cartridges with an uppermost cartridge of the one or more cartridges protruding at least partially from a front upper opening of the loading apparatus to define an advanced forward position of the uppermost cartridge;

(b) at least partially inserting a tip of the uppermost cartridge into one of the one or more chambers with the tip pointing in a downward vertical direction;

(c) engaging a release mechanism of the loading apparatus to free the uppermost cartridge from the loading apparatus; and (d) gravity feeding the uppermost cartridge into the one of the one or more chambers in which the tip of the uppermost cartridge was partially inserted.

17. A method of loading one or more cartridges into the loading apparatus of claim 1, the method comprising the steps of:

(a) engaging a release mechanism of the loading apparatus to move a follower of the loading apparatus away from an upper portion of the loading apparatus;

(b) inserting a first cartridge of the one or more cartridges into a front opening of the loading apparatus, the front opening located proximate to the upper portion;

(c) disengaging the release mechanism to allow the follower to engage the first cartridge;

(d) pushing the first cartridge straight back into the front opening such that the first cartridge engages a ramp surface of the upper portion and moves away from the upper portion; and (e) engaging the release mechanism of the loading apparatus to move the first cartridge and the follower away from the upper portion of the loading apparatus while maintaining an upward force on the first cartridge between the follower and the release mechanism.

18. A loading apparatus for a revolver, the loading apparatus comprising:

a housing including a forward wall, a rearward wall, first and second sidewalls extending between the forward wall and the rearward wall, an upper portion, and a forward opening defined between the forward wall and the upper portion;

a follower positioned within the housing and including an angled upper surface;

a spring positioned within the housing and configured to apply an upward force to the follower towards the upper portion of the housing; and a release mechanism defined on the housing, the release mechanism configured to selectively disengage the upward force of the spring from an uppermost cartridge of one or more cartridges when received by the housing while maintaining the upward force on the follower and any other cartridges of the one or more cartridges when received by the housing;

wherein the release mechanism includes a first cantilevered button integrally formed in the first sidewall of the housing and a second cantilevered button integrally formed in the second sidewall of the housing, and wherein the upward force of the spring is disengaged from the uppermost cartridge of the one or more cartridges received by the housing upon engagement of at least one of the first or second cantilevered button.

19. A loading apparatus for a revolver, the loading apparatus comprising:

a housing including a forward wall, a rearward wall, first and second sidewalls extending between the forward wall and the rearward wall, an upper portion, and a forward opening defined between the forward wall and the upper portion;

a follower positioned within the housing and including an angled upper surface;

a spring positioned within the housing and configured to apply an upward force to the follower towards the upper portion of the housing; and a release mechanism defined on the housing, the release mechanism configured to selectively disengage the upward force of the spring from an uppermost cartridge of one or more cartridges when received by the housing while maintaining the upward force on the follower and any other cartridges of the one or more cartridges when received by the housing, wherein an inner surface of the upper portion includes a ramp surface portion and a forward surface portion, the ramp surface portion is more steeply angled relative to the rearward wall than the forward surface portion, and wherein the ramp surface portion includes a smooth surface covering configured to reduce resistance on a cartridge of the one or more cartridges as the cartridge slides up and forward along the smooth surface covering of the ramp surface portion.

* * * * *